US005165740A

United States Patent [19]

Curnes et al.

[11] Patent Number: 5,165,740

[45] Date of Patent: Nov. 24, 1992

[54] ANTI-RACKING MEANS AND METHOD FOR CARGO CONTAINER DOORS

[75] Inventors: Dennis A. Curnes, Kenosha, Ill.; Charles W. Cherry, Edmond, Okla.

[73] Assignee: White Welding and Mfg., Inc., Kenosha, Wis.

[21] Appl. No.: 822,225

[22] Filed: Jan. 17, 1992

[51] Int. Cl.[5] ..... E05C 9/08

[52] U.S. Cl. ..... 292/218; 49/367; 72/58; 29/507

[58] Field of Search ..... 292/218; 49/367; 72/58, 72/342; 29/507, 523; 403/274, 277, 284, 285, 242

[56] References Cited

U.S. PATENT DOCUMENTS 4,014,138 3/1977 White ..... 49/367
4,597,687 7/1986 Colas ..... 403/274 X
4,753,466 6/1988 Umebachi et al. ..... 292/218
4,765,661 8/1988 Fukushima et al. ..... 29/523 X
4,843,857 7/1989 Krieps ..... 72/58
4,875,270 10/1989 Krips et al. ..... 403/274 X

FOREIGN PATENT DOCUMENTS 22185 of 1907 United Kingdom ..... 29/523

OTHER PUBLICATIONS

Blueprints-2 sheets, "Anti-Rack Ring" #SK-2226, Jul. 17,1978, and #4119, Apr. 29, 1976.

*Primary Examiner*—Richard E. Moore

[57] ABSTRACT

In a rotary tube locking mechanism, the rotary tube itself is expanded into and against a steel ring which journals the tube to form an obstruction. A guide plate cooperates with this obstruction to provide an anti-racking function.

2 Claims, 3 Drawing Sheets

ANTI-RACKING MEANS AND METHOD FOR CARGO CONTAINER DOORS

FIELD OF THE INVENTION

The present invention relates generally to anti-racking means for the doors of cargo containers and more particularly, to an anti-racking device which is low tech and whose fabrication lends itself to automation.

Cargo containers and the like having enclosed bodies are conventionally provided with a rectangular door frame. A pair of doors are adapted to be swung within the plane of the door frame to close or provide access to the interior of the container. A rotary bar locking mechanism is provided for retaining the doors closed within the door frame. The door frame comprises horizontal top and bottom frame members and vertical side frame members suitably welded at there adjacent corner ends to form a generally rectangular structure. As is more and more true in today's world, for purposes of economy, the container (including the door frame) is usually fabricated of structural members having the least strength practical.

Becasue of the weakness of the structural members, the door frame, by itself, would be subject to considerable distortion when racking forces are applied to the container. The door frame, therefore, is partially reinforced by the doors, and the frame and doors may be further reinforced by the rotary locking mechanism. That is, as a result of its design and manufacture, the anti-racking means are incorporated into the rotary locking mechanism. As the prior art reflects, there are various types of anti-racking means provided to reinforce the cargo container. Such prior art devices vary in their complexity and cost with the over-all objective being efficiency and economy.

SUMMARY OF THE INVENTION

It is an object of the present invention to provide a simple and dependable anti-racking means for cargo containers and the like, which will provide an auxiliary reinforcement for the cargo container and whose fabrication can be very economically automated.

The anti-racking means of the present invention comprises a controlled expansion out of the rotary locking tube itself into and over the top edge of a steel ring. The anti-racking obstruction is created in the rotary locking tube at a point such that when the doors are locked it abuts with a bearing surface located on the guide plate portion.

In a preferred embodiment, a rotary locking tube which has been pre-cut to a desired length is inserted into a fixture, and a steel ring is journaled at a predetermined location. The wall of the tube, which is within and adjacent the ring, is displaced against the inside and top of the ring.

DESCRIPTION OF THE PREFERRED EMBODIMENTS

Figure 1:
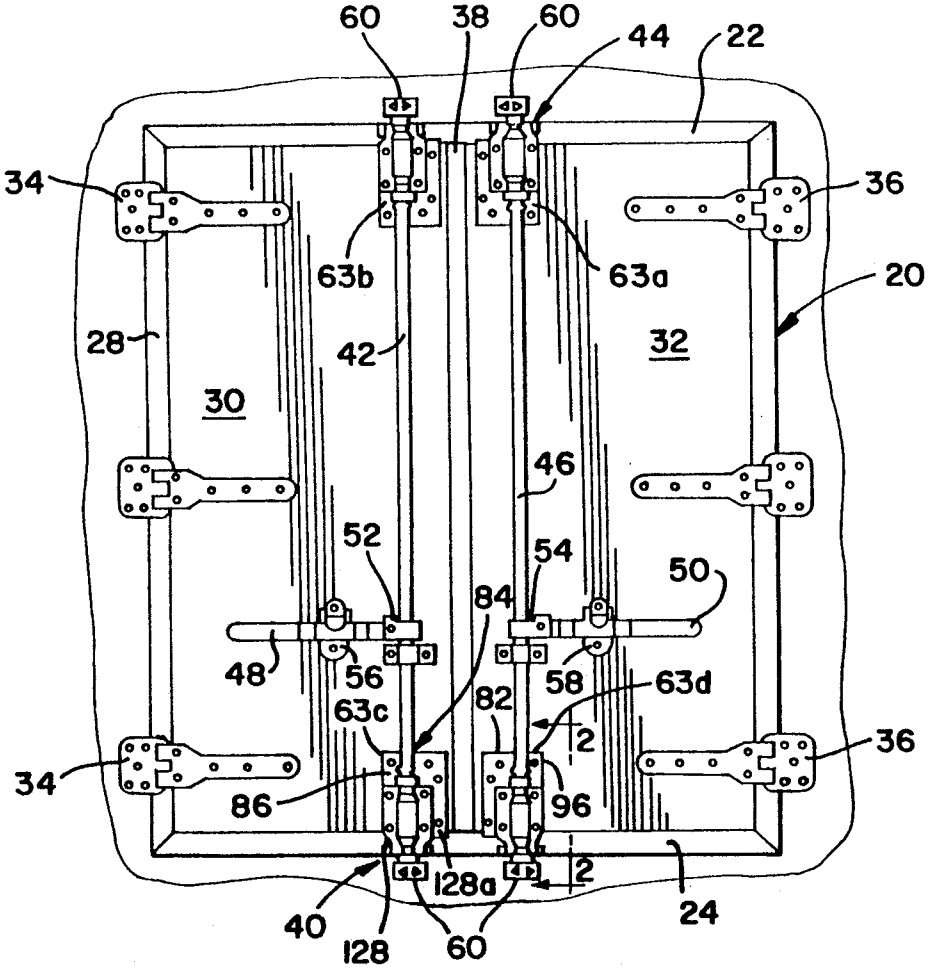
FIG. 1 is an elevational view of a door frame and a pair of doors within which one embodiment of hte anti-racking means of the present invention is incorporated.

Referring now to FIG. 1, there is indicated generally by the reference number 20 a conventional door frame which may be, for example, located at the rear end of the body of an enclosed cargo container. The door frame 20 comprises horizontal upper and lower structural elements 22 and 24 and vertical side structural elements 26 and 28. Disposed within the door frame 20 for closing the same are a pair of doors 30 and 32 which are vertically hinged to the side door frame elements 26 and 28 by means of hinges 34 and 36. To provide a suitable seal enclosure, resilient strip material 38 (shown in FIG. 2) of generally H-sectional configuration, may be secured above the edges of the doors 30 and 32, with the strip material along the vertical free edge of the door 32 being arranged to overlap the vertical free edge of the door 30.

The door 30 is adapted to be secured within the door frame 20 by means of rotary tube door locking mechanism 40 including the vertically disposed rotary locking bar or tube 42, while the door 32 is adapted to be secured within the door frame 20 by means of rotary tube door locking mechanism 44 which includes the vertically disposed rotary tube 46. Means for rotating the locking tubes 42 and 46 are provided in the form of revolvable elements or handle levers 48 and 50 pivotally mounted to brackets 52 and 54, and secured to the tubes 42 and 46 respectively. The hand levers 48 and 50 are normally retained in sealed assembly or retainer means 56 and 58. Arranged for association with each of the upper and lower ends of the rotary door locking tubes 42 and 46 are keeper members 60 secured to the upper and lower door frame elements 22 and 24; additionally associated with the respected upper and lower pairs of ends of rotary tubes 42 and 46 are anti-racking means 63*a, b, c* and *d*. Each rotary locking assembly and each anti-racking means is identical and thus discussion will be generally limited to one shown in FIG. 2 with the understanding that it applies equally well to all the others.

Figure 2:
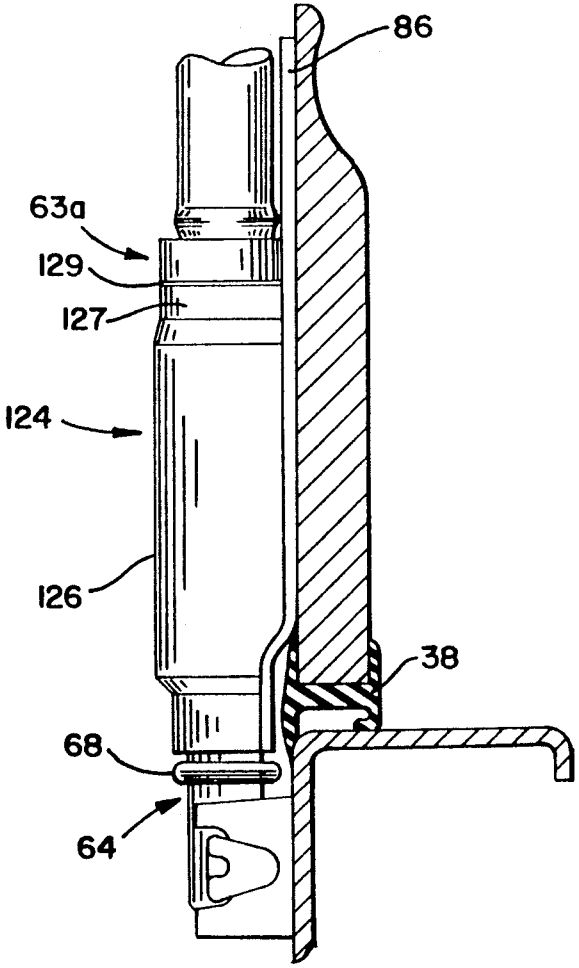
FIG. 2 is a vertical sectional view taken substantially along the line 2—2 of FIG. 1 looking generally in the direction indicated by the arrows.
Figure 6:
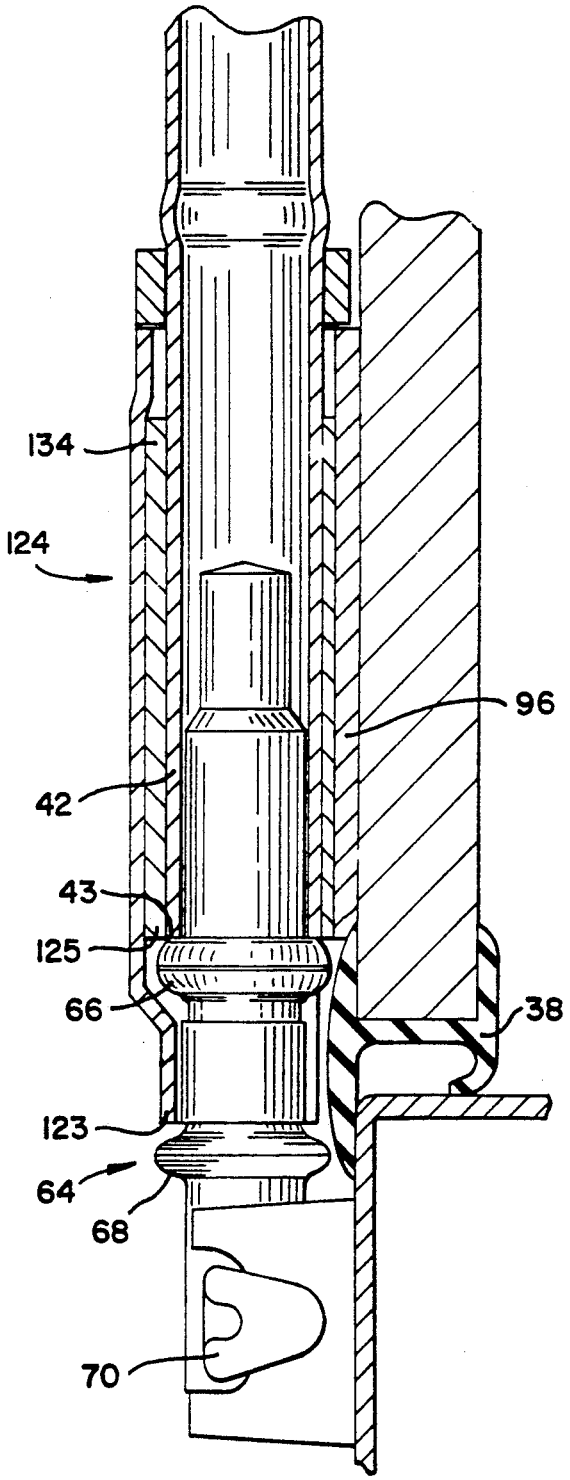
FIG. 6 is a more complete view which is a partial elevation sectioned axially of the entire assembly showing the anti-racking means.

Each locking tube 42 and 46 has secured in each end thereof a separate bar end, such as 64, one of which is shown in FIG. 2 and FIG. 6. Each bar end 64 includes a pair of axially spaced annular collars 66 and 68 and a pair of generally radial extending arm portions, one of which is shown as number 70. Each keeper member 60 has laterally spaced forwardly extending projections wherein the locking bar arm portion is adapted to be engaged or received respectively.

Each rotary tube door locking mechanism 40 and 44 also includes a pair of brackets 82 and 84.

The brackets 82 and 84 are substantially identical in configuration and any discussion applies to both. Each base portion 86 and 96 are secured to its respective door and are provided with an intermediate bore through which passes the rotary tube. In association with each base portion is a guide plate 124 characterized by a generally semi-cylindrical vertically disposed central portion 126 and a pair of side flanges 128 and 128*a*. The tope edge of the central portion 126 is necked down as at 127 to create a bearing surface 129.

The side flange 128 and 128*a* and the adjacent base portions 86 or 96 are suitably secured to the adjacent door by means of bolts. A vertical split bearing 134 may be mounted in each front guide plate 124. The end 43 of the locking tube 42 is accommodated between the front guide plate 124 and the respectively bracket portion 96 which serves as a backing plate. The locking bar collars 66 and 68 bear against the end surfaces 123 and guide plate 125. Thus, the arrangement of the collars and the abutments restrain the four different ends of the locking tubes 42 and 46 and portions of any axial racking forces exerted on the ends of the locking bars 42 and 46 are transmitted to the associated hardware to the doors 30 and 32.

As is apparent, the locking bar collars 66 and 68 are formed in and a part of the bar end 64. The entire assembly is a solid forged piece which during the fabrication of the locking bar is press fit and welded into the locking tube.

Figure 4:
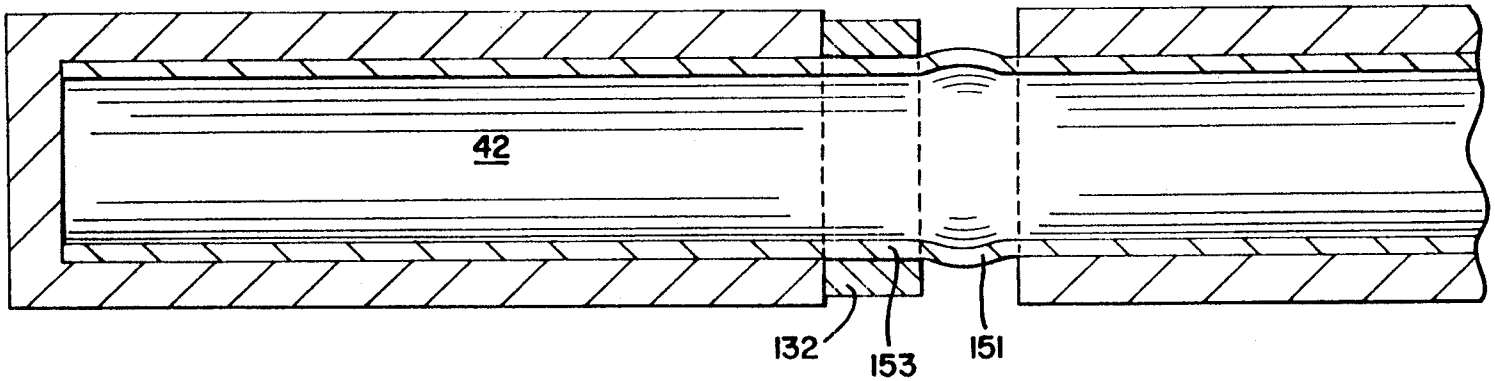

Referring now to FIG. 4, wherein is shown the preferred embodiment of my anti-racking device. The concept encompassed by this invention utilizes a steel ring 122 that is swaged in place on a tube such as 42 through the employment of forging pressure. The forging pressure not only locks the ring 122 to the tube 42 without welding, but also creates a shoulder 151 on the tube 42 to prevent any possible displacement of the ring 122 in the direction of applied forces such as racking forces. The forging pressure applied to the tube 42 with the ring 122 in place around it, causes a circumferential upset of the tube wall material 153 which creates an interference fit between the ring 122 and the upset material of the tube 153, thus bonding or locking them together. As is known, when metal is folded over against itself or extremely distorted, it tends to develop cracks and/or other structural weaknesses. It has been found that the ring 122 when so employed, in conjunction with the forging pressure, controls the deformation of the tube to create the shoulder and yet not allow the metal to fold over or deform extensively. Further, the swaging operation actually increases the strength of the tube material in the critical joint area due to the cold working of the tube material 153 during the forming process.

Figure 5:
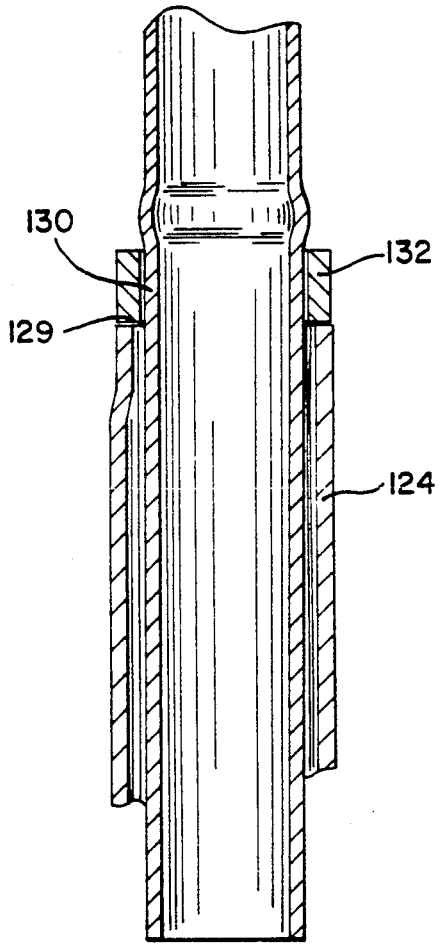
FIG. 5 is a partial elevation, sectioned axially, of the rotary tube, steel ring and the cam guide.

The location of the steel ring 122 is such that it cooperates with the bearing surface 129 as shown in FIG. 5. Note should also be made as to the thicknesses of the load bearing structure at this particular juncture. As is apparent in any type of metal upsetting process or radical to the deformation of a tube wall, it is possible to thin down the wall itself. That is, the wall has reduced load carrying capacities. In consideration of FIG. 5, it will render it apparent that the wall or load bearing capacity of this structure in the critical aea 130 is represented by the combined wall thicknesses of the tube 42 and the steel ring 122. Because there is no welding involved in the fabrication, the alignment of the ring bearing surface 132 with that of the surface 129 can be controlled to be generally true. One of the prior art methods of constructing such anti-rack devices involves the placing of a steel ring over a tube, followed in some order by tack welding of the ring to the tube. Because of the nature of the materials involved, the tack welding operation causes heat distortions which change the relationship of the bearing surfaces 132 of the ring 122, to the bearing surfaces 129. As a result, the surfaces are not true when the circumferential welding of the ring to the tube takes place. Additionally, further heat distortion may take place during the circumferential weld and thus it is hard to maintain proper alignment and comply with a rigorous quality control procedure.

The embodiment as shown in FIG. 5 achieves all of the advantages of the prior art devices and yet does not offer any opportunity for heat distortion incident to welding or from wall thinning or fractures due to radical deformation of the wall material. Still further, the process lends itself to automation whereby quality control can be further enhanced.

The anti-racking means as shown in FIG. 5 includes the upset material 153 which has been swaged to the interior of the tube 122 and the fold or shoulder 151 further preventing movement of the ring 122 toward the top of or upwardly as shown in FIG. 5. The bearing surface 132 of ring 122 cooperates with the bearing surface 129 of the neck-down portion 127 of the guide plate 124. As previously explained, the bearing surface 129 and the bearing surface 132 are generally very parallel and thus provide the very maximum of surface contact. Additionally, the wall thicknesses in this area comprise the thickness of the ring 122 and the thickness of the upset tube in that area which is slightly thicker than the wall of the tube.

Figure 3:
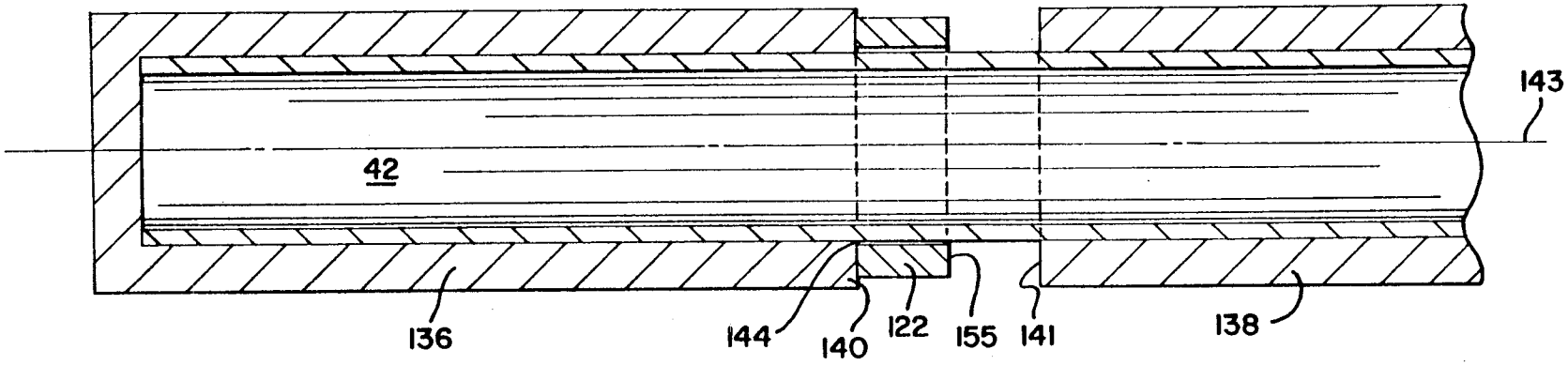
FIGS. 3 and 4 are cutaway views showing simplified equipment employed in the fabrication of the anti-racking means.

Referring now to FIGS. 3 and 4, wherein one method for the manufacture of the swaged anti-racking ring as disclosed. It should be appreciated that this is simply a preferred embodiment. Initially, as referring to the structure in FIG. 3, a ring 122 is slipped over the tube 42. It will be noted from consideration of FIG. 3 that the OD of the tube 42 is slightly less than the ID of the ring 122. In the particular embodiment hereunder consideration, this difference in ID and OD is about $\frac{1}{8}$th of an inch. This provides the opportunity for the displaced tube material to flow into and strengthen this critical area within the ring itself. The next step includes the gripping of the tube about $\frac{1}{2}''$ above the top surface 155 of the ring 122. The tube below the bearing surface 132 of the ring 122 is contained. It should be noted that any suitable containment means such as 136 and any gripping means such as 138, will be satisfactory. An important feature of the containment feature 136 is that once forming pressure has been applied, the containment means will release or allow removal of the compressed tube. For this purpose, it may be necessary to use a split containment means which can be opened to allow removal. A further critical feature of the containment means is the provision of a surface 140 which is absolutely perpendicular to the major axis 142 of the tube 42. As a result, the bearing surface 132 of the ring 122 will be properly aligned for cooperating with the bearing surface 129 of the guide plate 124. The last operation being disclosed is the provision of forming pressure along the major axis 143. It is not critical whether the deformation 151 begins at the bottom edge 141 or adjacent to the top edge 144 of the containment means. The results will be the deformation of the material, such as the swaged portion 153 and the shoulder portion 151. Of the total length of the tube 42, approximately $\frac{3}{8}''$ thereof is employed to create the swaged portion 153 and shoulder portion 151.

The anti-racking device as shown in FIG. 3 is prior to the application of the forging pressure. The structure shown in FIG. 4 is the anti-racking ring as completed after the application of a forging pressure and the reduction of the over-all tube length by approximately $\frac{3}{8}''$ per ring. The final steps in the operation are then the removal of the tube from the containment means 136 and the release of the holding means 138. Thereafter the locking bar 64 is press fit and welded into the locking tube 42 and then assembly takes place into the final structure as shown partially, for example, in FIGS. 5 and 6. As is apparently, the process lends itself to automation and the manufacture of a product of very close tolerances.

There has thus been provided a rotary tube door locking means which includes a new improved anti-racking means and a method for producing the same. The anti-racking means is produced without the introduction of heat either in the form of welding or through other external heaters anywhere in the method. Only a small portion of the rotary tube wall is set and thus the risk of metal cracking or thinning of the wall is eliminated.

While there has been shown and described various embodiments of the present invention, it will be understood by those skilled in the art that various rearrangements and modifications may be made therein without departing from the spirit and scope of the invention.

We claim:

1. A rotary tube door locking means used on the doors of cargo containers having an anti-racking means comprising:

a guide plate means having a bearing surface means;

a rotary locking tube having a major axis and an outer wall;

a ring journalling said tube, said ring having an upper bearing surface, a lower bearing surface and an inner wall, both said upper bearing surface and said lower bearing surface being generally perpendicular to the major axis of said tube and said outer wall of said rotary locking tube being swaged against said inner wall of said ring;

a shoulder cold formed from said tube and compressed against said upper bearing surface whereby said bearing surface of said guide plate interacts with said lower bearing surface to resist racking.

2. The anti-racking means of claim 1 wherein said ring has an inner diameter and said rotary locking tube has an outer diameter, said inner diameter being about $\frac{1}{8}''$ greater than said outer diameter creating a gap therebetween whereby upon compression of said rotary locking tube along said major axis said tube is displaced into said gap.

* * * * *